US005846302A

United States Patent [19]

Putro

[11] Patent Number: 5,846,302

[45] Date of Patent: Dec. 8, 1998

[54] ELECTROSTATIC AIR FILTER DEVICE

[75] Inventor: Michael G. Putro, Woodbine, Md.

[73] Assignee: Aqua-Air Technologies, Inc., Woodbine, Md.

[21] Appl. No.: 840,075

[22] Filed: Apr. 24, 1997

[51] Int. Cl.[6] ..... B03C 3/155

[52] U.S. Cl. ..... 96/66; 96/80; 96/99

[58] Field of Search ..... 96/60, 65–69, 96/98–100, 80, 55, 57–59; 55/DIG. 39, 527, 528

[56] References Cited

U.S. PATENT DOCUMENTS

| | | | |
|---|---|---|---|
| 2,085,758 | 7/1937 | Krutzsch | 96/80 X |
| 2,908,347 | 10/1959 | Roos | 96/67 |
| 4,549,887 | 10/1985 | Joannou | 96/58 |
| 4,781,736 | 11/1988 | Cheney et al. | 96/67 X |
| 4,828,586 | 5/1989 | Joannou | 96/66 |
| 4,886,526 | 12/1989 | Joannou | 96/67 |
| 4,978,372 | 12/1990 | Pick | 96/67 |
| 5,059,218 | 10/1991 | Pick | 96/66 |
| 5,108,470 | 4/1992 | Pick | 96/58 |
| 5,137,552 | 8/1992 | Sasaki | 96/80 |
| 5,364,458 | 11/1994 | Burnett et al. | 96/80 X |
| 5,573,577 | 11/1996 | Joannou | 96/66 |

*Primary Examiner*—Richard L. Chiesa

*Attorney, Agent, or Firm*—Nikaido, Marmelstein, Murray & Oram LLP

[57] ABSTRACT

A self-contained electrostatic air filter assembly having two hinged rectangular frames into which is disposed rectangular polyester/wool filter dielectrics with a conducting charging screen in between. The polyester/wool dielectrics are charged through the conducting screen by a high voltage power supply having a low source resistance. The high voltage supply having a small source resistance is integrated into the air filter assembly and connected electrically to the conducting screen. High voltage is quickly dissipated from the screen and dielectrics when the unit is turned off by a specially designed bleeder resistor. As an air mass is forced through the filter, particulates in the air are removed electrostatically quickly and efficiently by the charged polyester/wool filter material. The air filter assembly has been shown to have a high particulate capacity. Because the assembly is completely self-contained, it may be installed in a variety of environments including residential or commercial forced air heating ductwork, ceiling mounted units or in a free-standing cabinet.

9 Claims, 7 Drawing Sheets

ELECTROSTATIC AIR FILTER DEVICE

BACKGROUND OF THE INVENTION

The present invention relates to an electrostatic air filter for removing particles from air in a closed space, which comprises a compact frame containing a special filter material which is charged by a high voltage power supply integrated into the frame.

Numerous electrostatic air filtering devices are known, including ionizers for removing particles from an air stream that produce negatively charged ions that combine with other airborne particles in the air and are then attracted to walls and other surfaces inside and outside of the device. Electrostatic precipitators are also known which include a duct containing charge applying means that uses a high voltage corona discharge that charges airborne particles, and then downstream thereof with respect to the flow of air, a plurality of electrically conductive metal baffle plates, which may be oppositely charged, attract the charged particles (e.g. of 0.30 micron) which adhere thereto and to the subsequent downstream walls. Because these devices, unlike the invention described herein, do not have a charged filter material through which the particulates in the air must pass, they are not particularly efficient and require a very high d.c. potential in order to charge particles across a large air gap. This d.c. potential is particularly expensive to produce and, in operation, can produce undesirable amounts of ozone which can be detrimental to the health of individuals who breath it. In addition, some such devices which produce excessive amounts of ozone are banned in the United States and Canada.

In certain previous air filter designs, such as the designs described in U.S. Pat. Nos. 4,549,887 and 4,828,586, both issued to Joannou, performance and reliability has been limited for at least three reasons. First, previous designs have used high voltage power supplies which were not able to maintain a sufficiently high voltage on the filter material as the material collected particulates during normal operation. Second, other designs have not adequately addressed the problem of quickly removing high voltage from the high voltage output and the filter material when the unit is shut off for filter replacement or service. Third, previous designs have used filter materials which, as particulate matter builds up, quickly become conducting and short out the applied high voltage.

The performance of prior electrostatic air filter designs has suffered from the use of high voltage power supplies which did not have a sufficiently low source resistance to maintain an adequate voltage on the charging screen as the filter material becomes conducting in use. In certain power supply designs, the d.c. supply voltage is created by half-wave rectifying a 24-volt input voltage using a single diode/resistor combination and regulating the voltage with a single Zener diode. The voltage on the Zener diode is then crudely smoothed using a large parallel capacitor. While this arrangement creates a serviceable supply voltage, such a voltage supply has an inherently large source resistance. This limits the voltage available to the charging screen as demands for current increase. As the dielectric screens begin to fill with collected dust and current begins to flow from the high voltage output, the d.c. supply voltage will drop and, in turn, the high voltage will fall. Thus, the high source resistance of the d.c. supply will be reflected as a high source resistance in the voltage multiplier. The result will be degraded performance as the high voltage drops in response to only small amounts of material collected in the dielectric screens. As discussed below, this problem has been addressed in the present invention by using a new low source impedance power supply to apply high voltage to the filter material.

The problem of discharging the high voltage from the filter unit when it is time to change the filter material has, previous to the present invention, also not been adequately solved. The high voltage present on the metal charging screen, which is connected to the high voltage supply for the purpose of charging the fibrous air filter material, must be removed before the user comes into contact with the region of high voltage to prevent dangerous shocks.

In U.S. Pat. No. 4,549,887 to Joannou ('887), a self contained air filter arrangement is disclosed having a metal charging screen in contact with two fibrous rectangular filters. In the '887 design the filter unit comprises two frames supporting outer wire screens and a frame supporting the charging screen, such that all three of the frames are joined by hinges at one edge. Thus, the fiberglass filter material, rectangular in shape, can be inserted on either side of the charging screen and be sandwiched between the outer screen when the unit is closed and latched. In an attempt to solve the problem of discharging the high voltage from the charging screen whenever the unit is opened, a spring element is disclosed in the '887 patent which is connected to ground and is ordinarily prevented from contacting the charged wire screen when the unit is closed and operating. This is accomplished using a post attached to one of the outer frames which, when the unit is closed, passes through a hole in the charging screen and displaces the grounded spring element, preventing it from contacting the charging screen.

In actual practice, however, this discharge design has proven to be unreliable and troublesome because, when the unit is operating and high voltage is applied to the charging screen, the spring grounding element can be disposed too close to the charging screen, and shorting and arcing to the grounding element can occur. These problems may occur if the unit has been roughly handled and the grounding element has been displaced from its preferred position, resulting in accidental contact of the grounding element with the charging screen. Other problems occur because of the requirement that the spring be disposed in close proximity to the charging screen so that the screen grounding element will contact the screen when the unit is opened. This proximity increases the opportunity for arcing across the air space when atmospheric conditions lower the breakdown voltage of the ambient air.

In the electronic air filter disclosed in U.S. Pat. No. 4,828,586, also to Joannou ('586), it is necessary for the entire high voltage power supply unit to be removed from the air cleaner unit in order to discharge the voltage on the conducting screen so that the dielectric screens can be serviced. The low voltage input plug is first removed from its socket on the high voltage power supply board and then the board is pulled free from its retaining clips. A discharge wire physically mounted to the conducting screen is arranged to spring into contact with a grounding element when the high voltage power supply unit was removed. During normal operation, when the power supply is in place, a 2"–3" pin physically connected to the power supply board and electrically connected to the output of the power supply, holds the discharge wire away from the grounding element and supplies the high voltage to the conducting screen through the discharge wire itself.

However, this purely mechanical shunting arrangement can lead to extremely high failure rates in the hands of users.

This is because the discharge wire, which is connected to the conducting screen, is required to be located quite near the grounding element during normal operation. Bumping or jarring the unit in use or when the unit is opened for maintenance can result in a bending or misplacement of the discharge wire. Accidental discharge of the high voltage supply when the wire touches or merely arcs over to the grounding element is quite possible. Discharge of the high voltage when the unit is operating can result in the failure of one or more diodes in the voltage multiplier stage of the supply, placing the entire unit out of operation and requiring return of the power supply to the seller for repair. Mechanical shunting of the high voltage components has been completely eliminated in the present invention to avoid the problems set out above.

Finally, electrostatic air filters previously known in the art have also suffered because the filter material used, usually a fiberglass mat of the kind commonly used in ordinary forced air home furnace systems, quickly becomes electrically "leaky" as the filter begins to collect a certain quantity of particulate. This results in degraded performance, as current begins to flow from the high voltage power supply, and the voltage across the filter material drops.

In contrast to the above described filter material, however, the present invention uses a filter material consisting of a mat of polyester/wool. The polyester/wool material has been shown to be superior to the ordinary fiberglass material with respect to electrical leakage, as the new material has been demonstrated to have an extremely low electrical conductivity even as large quantities of particulates from the air mass are collected. In addition, the new polyester/wool material has been shown to have excellent performance characteristics with respect to particulate arrestance and time between replacement.

Dramatic improvements in performance over previously known electrostatic filters have been achieved using the polyester/wool filter material in combination with the new low source resistance high voltage power supply of the present invention. The new filter material and robust power supply make sure that the filter is always charged at over 7 kvolts, which maximizes the ability of the filter to trap particulates in the air mass. In addition, a high level of operational reliability has been achieved as a result of using a bleeder resistor to discharge high voltage from the charging screen rather than using the mechanical means of previous disclosures.

OBJECTS AND SUMMARY OF THE INVENTION

It is an object of the present invention to provide an electrostatic filter which is capable of removing a large total quantity of particulate matter from an air flow before requiring cleaning of the filter material.

It is a further object of the invention to provide an electrostatic filter which, because of the use of a special polyester/wool fiber and a high charging voltage, has a high removal efficiency of particulate matter including dust, pollen and smoke present at the air flow input of the filter.

It is a further object of the invention to provide a filter which is powered by a high voltage power supply with a low source resistance which has proven to be highly reliable in actual operation.

It is another object of the invention to provide an electrostatic filter embodied in a completely self-contained, compact package which may be installed in a wide variety of situations, including home and commercial heating and cooling ducts, ceiling mounted units or stand-alone consoles which integrate the filter with a fan unit for forcing air through the filter.

Finally, it is an object of the invention that the high voltage power supply features a self-discharging capability which prevents the user from receiving a shock when the filter frame is opened without suffering the reliability problems of previously disclosed air filters.

According to the present invention, an electrostatic filter is made into a compact assembly made up of a first rectangular frame having a top, bottom and two side edges with a first wire mesh disposed within the first frame; a second rectangular frame having a top, bottom and two side edges, with a second wire mesh disposed within the second frame, the second frame being joined at one side edge to one side edge of the first frame by a hinge means; first and second rectangular polyester/wool dielectrics disposed between said first and second frames; a rectangular charging screen (preferably a wire mesh) disposed between the first and second polyester/wool dielectrics for distributing charge to the first and second dielectrics; and a high voltage power supply, having an output terminal and a high voltage wire electrically connected to the output terminal, the power supply being disposed on an edge of the first rectangular frame such that the high voltage wire physically and electrically contacts the charging screen when the first and second rectangular frame are closed to form the air filter assembly, where the high voltage power supply comprises a voltage multiplier output stage having a shunt resistor to ground for quickly discharging the charging screen when the power supply is de-energized.

The high voltage power supply is comprised of a multistage device. The first stage is a direct current power supply stage having an input and an output, wherein the input is connected to an output of an alternating current adapter of the type ordinarily used in the home, which can be plugged directly into a wall outlet. The next stage is an oscillator stage having an input and an output, where the input of the oscillator is connected to the output of the direct current power supply. A step-up transformer follows such that the primary of the transformer forms the output of the oscillator stage. Finally, the last stage of the power supply is a voltage multiplier stage having an input connected to the secondary winding of the transformer, where the output of the multiplier forms an output of the high voltage power supply.

The assembly may be integrated into a cabinet with a fan or other means for forcing room air through the filter assembly to form a stand-alone console, which would ordinarily use the electrical power from the room electrical outlets to supply the electrical requirements of the air filter assembly's high voltage power supply.

In addition, the air filter assembly maybe be integrated into a conventional forced air system including a conventional furnace and/or air conditioning system. Power to the assembly can be supplied by an ordinary 24 volt a.c. adapter to the input jack of the high voltage power supply.

Because the failure rate of units constructed according to previously known designs was found to be unacceptably large, a new method for discharging the conducting screen was developed which dramatically improves the reliability of the air cleaner unit. The new method eliminates entirely the mechanical shunting arrangement used in previously disclosed air filter designs and, instead, employs a specially manufactured resistor, connected from the output of the high voltage supply to ground, to bleed away relatively quickly the high voltage on the output when the power to the unit is turned off The special resistor is designed to have an extremely high value of resistance at the operating voltage. By this method, the conducting screen can be permanently connected to the output of the high voltage supply using a well insulated rigidly placed cable, thus avoiding the accidental discharge problems encountered with the spring mounted arrangement.

In particular, the bleeder resistor is specially designed to have a resistance of 1000 Mohms, and is manufactured with a high length to width aspect ratio to reduce the probability of arcing from the input to its output. The resistor is designed to maintain a low current leakage at voltages in excess of 7.5 kvolt. Although the value of the resistor is quite high, the capacitance in parallel with the resistor is low, so that the effective RC time constant is small enough to ensure that the voltage on the conducting screen is bled away before the consumer would ordinarily come in contact with the inside of the air cleaner unit after turning the power off for service.

In addition, other advances in power supply design are incorporated into this invention which have contributed to improved performance and reliability characteristics over the filter described above.

In order to reduce the source resistance of the power supply, a more robust supply is used in the present invention. The present invention uses a full-wave rectified signal which is first smoothed using a large capacitor, and then applied to a 24-volt integrated circuit linear regulator. The result is a d.c. power supply stage with a much lower source resistance, which is reflected in a lower source resistance in the high voltage output stage. This reduction in the source resistance of the power supply contributes to the improved performance characteristics found in the newly designed air cleaner.

The improved performance offered by the design of the present invention is due also in large part to a unique filter material. The filter material used in this invention is a blend of polyester and wool which exhibits a substantially higher polarizability when compared to other filters made of fiberglass used previously in the art, for example, in the electrostatic filter disclosed in U.S. Pat. No. 5,108,470 issued to Pick. The polyester/wool material is approximately 50% polyester and 50% wool although blends ranging from 40% polyester and 60% wool to 60% polyester and 40% wool fall within the operative range of the invention. The higher polarizability obtainable with the polyester/wool material allows the filter to capture particulates faster and more efficiently than other materials, and the polyester/wool filter has also been shown to have a much higher total capacity for dust and other particulates. The density of the polyester/wool material is such that an adequate airflow can be maintained even while particulates are efficiently captured from the air mass. The use of the new material contributes significantly to the improvements in performance over previously described air cleaners.

Unlike fiberglass filters, this new filter material is safe to handle without irritation. It has recently been suggested that fiberglass may present some of the same health risks as asbestos with respect to its ability to irritate skin, eyes and the respiratory system. Certain studies have also identified fiberglass as a carcinogen when breathed into the lungs in sufficient quantities. Peter F. Infante, et al., "Fibrous Glass and Cancer," American Journal of Industrial Medicine Vol. 26(1994), p. 559.

Therefore, the polyester/wool material used in the present invention offers improved performance and safety over previously disclosed designs which use fiberglass filter material.

DETAILED DESCRIPTION OF PREFERRED EMBODIMENTS

Figure 1:
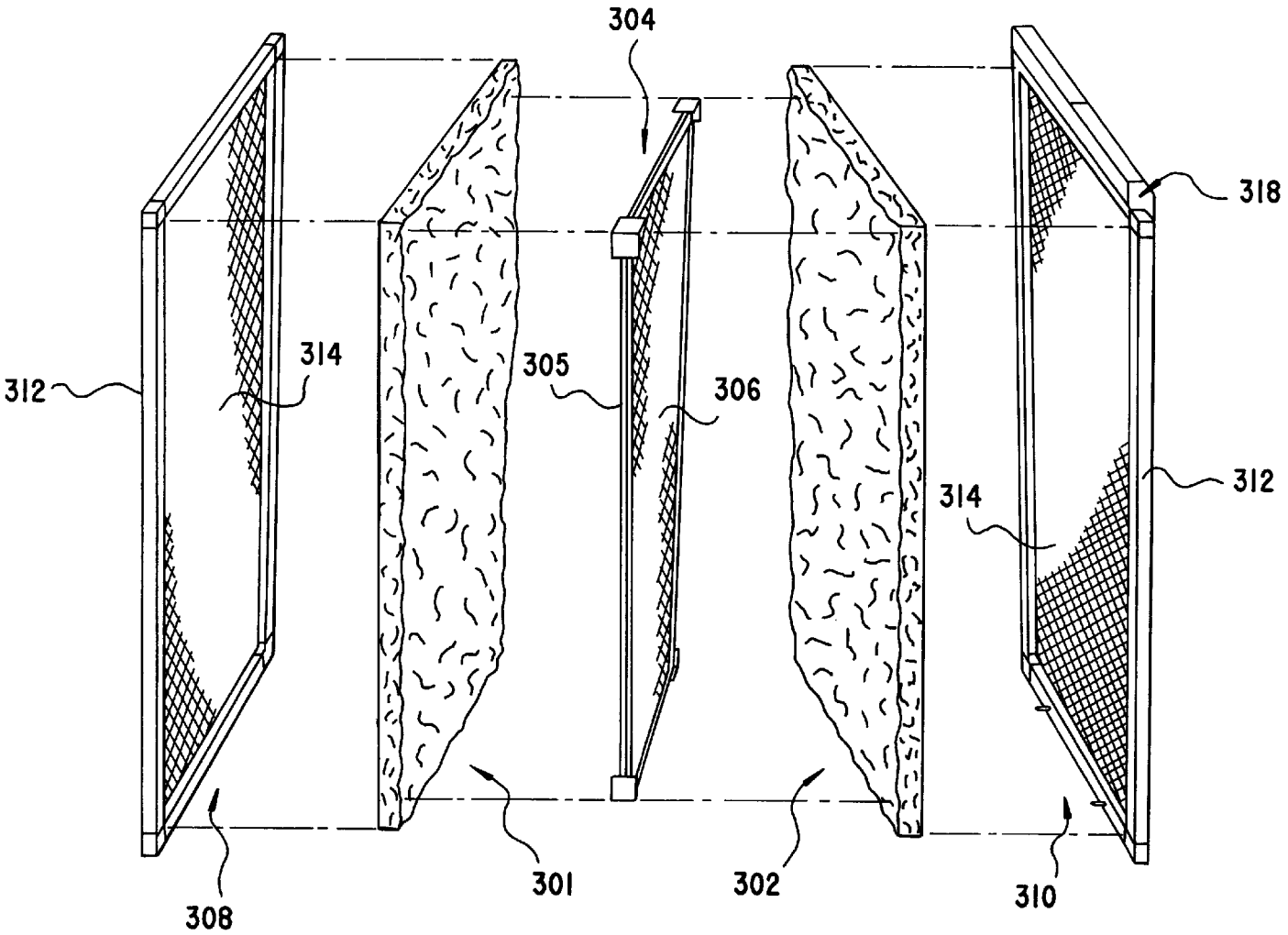
FIG. 1 is an exploded view of the elements which make up the air filter assembly.

A first embodiment of the electrostatic air filter assembly 30 is illustrated in FIG. 1 and comprises two sheets 301, 302 of filter material for gas formed of a dielectric material such as a non-woven matting of polyester/wool blend and being of the same rectangular shape and size.

A charge applying means 304 is normally sandwiched between sheets 301, 302, and comprises a rectangular metal frame 305 of extruded aluminum onto which a rectangular charging screen (preferably a wire mesh) 306 is disposed. The charging screen 306 can have another structure such as a metal gauze or perforated metal sheet or a grill of wires or a punched metal lattice.

A first earthed or ground means 308 comprises a rectangular metal frame 312 which also functions as a housing and support of the device and is formed from four rectangular aluminum extrusions interconnected, for example by plastic angle pieces. A rectangular wire mesh 314 is located within frame 312.

The second earthing or ground means 310 is substantially the same as ground means 308 and also comprises a rectangular metal frame 312 formed of hollow extruded aluminum sections and has a wire mesh 314 extending between the sides thereof and located in the same manner.

The two frames 308, 310 are of the same size and shape as each other. The two sheets of polyester/wool filter material 301, 302 are of the same size and shape as each other but slightly smaller than frames 308, 310 so as to be clampable therebetween with the edges preferably abutting or even slightly overlapping the inner peripheral edges of the frames and so as to ensure air passing through the wire meshes 314 and also through the filter material. The frame 305 is smaller than the inner periphery defined by the frame members 308, 310 and the charge applying means 304 therewithin.

Figure 2:
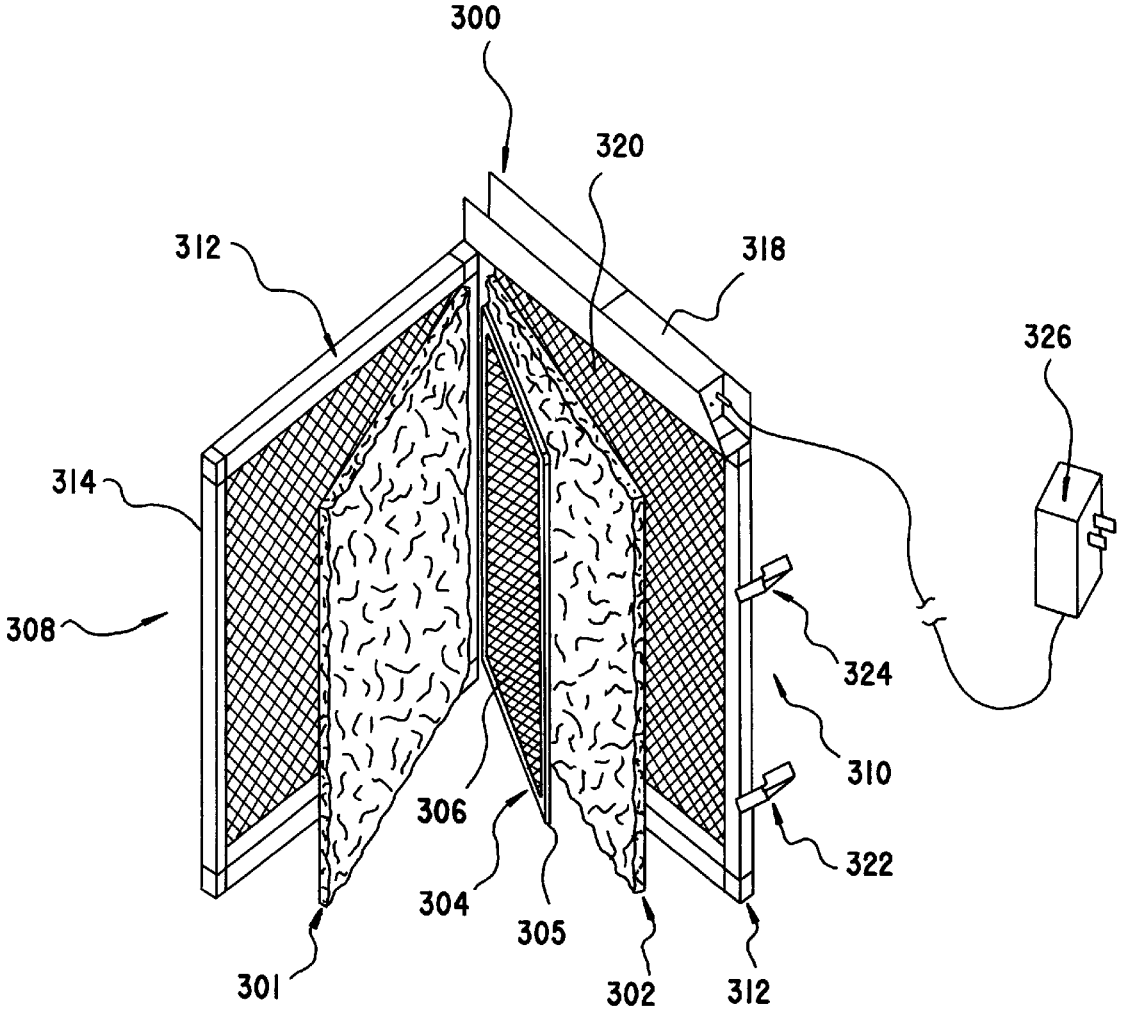
FIG. 2 shows the arrangement of the air filter assembly elements when the assembly is in the open position.

As shown in FIG. 2, the frames 308 and 310 are hinged at one edge such that filter elements 301, 302 and the wire mesh 304 can be clamped between them. Latches 322 and 324, which are pivotably attached to one of the frames 312, are arranged to swing over the outside edges of both frames 312 to secure the resulting assembly.

Electrode 320 in FIG. 2 is arranged such that the filter element 302 will fit between the electrode and wire mesh 312. Thus, when frames 312 and 314 are closed and latched, electrode 320 makes physical and electrical contact to the charging screen 304.

Figure 3:
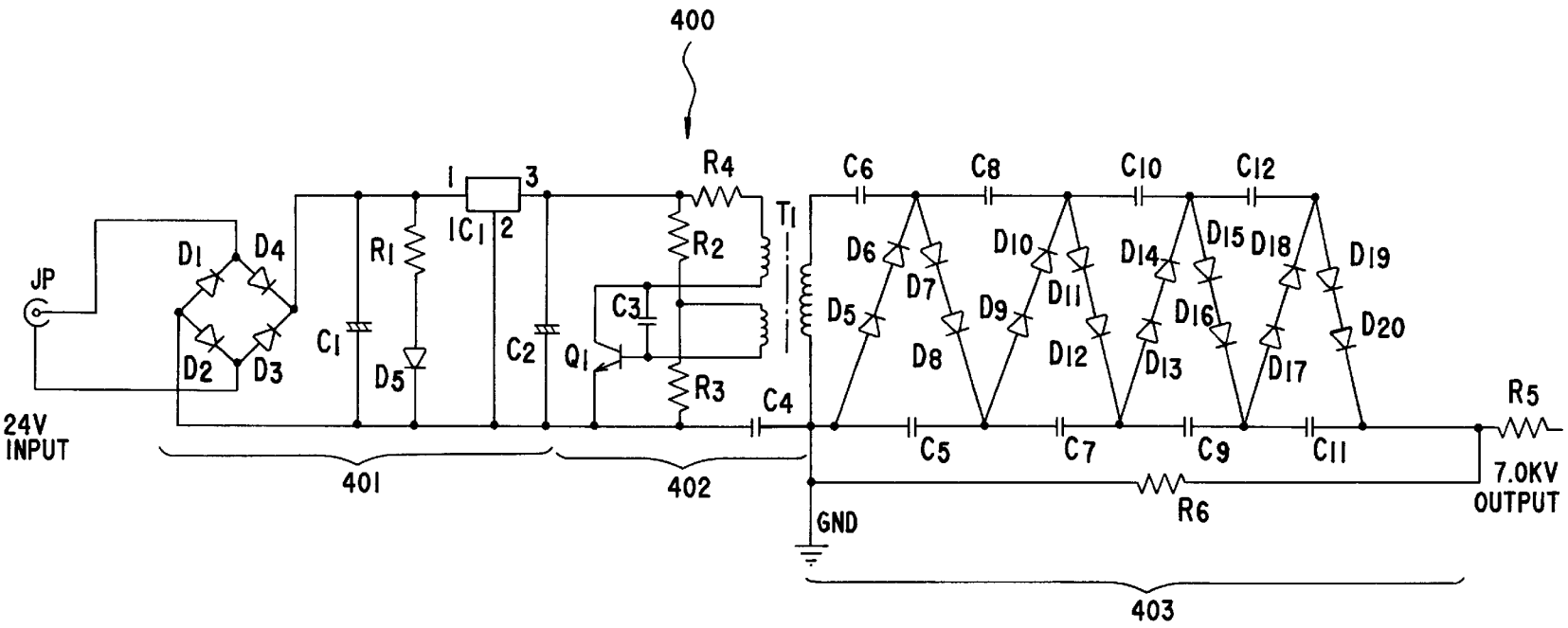
FIG. 3 is a schematic diagram of the high voltage power supply circuit.

Mounted in the channel 318 of Fig. 2 is the high voltage power supply 400, which is detailed in FIG. 3. Transformer 326 supplies 24 volt a.c. power from a wall outlet to the power supply 400. The power supply 400 provides high voltage to electrode 320 which charges the filter elements through a conducting path provided by charging screen 304.

The high voltage power supply 400 comprises a d.c. power supply stage 401, which supplies power to an oscillator stage circuit 402, the output of which is stepped-up by transformer $T_1$ which in turn feeds the input of voltage multiplier 403. The output of the voltage multiplier stage 403 is shunted to ground through resistor $R_6$. Resistor $R_6$ has a value exceeding 1000 Mohms and has an extremely low current leakage value at the operating voltage. The resistor is provided to quickly bleed the high voltage from the output of the power supply and from charging screen 304 whenever the power to the unit is turned off to service the filter. Because the capacitance in parallel with $R_6$ is quite small, the high voltage will bleed away before the user will ordinarily be able to access the charged charging screen 304. This protects the customer from coming into contact with a voltage which may be as high as 7.0 kvolts.

The use of resistor $R_6$ to bleed away the high voltage in this invention provides an enormous advantage over the cumbersome and unreliable mechanical methods for discharging the high voltage used in previously known electrostatic air cleaners.

Power is supplied to the air filter assembly through a small electrical jack designated as JP in FIG. 3, mounted on the power supply circuit board. The power is typically supplied as 24 volts a.c. from a commonly available wall outlet adapter.

Figure 4:
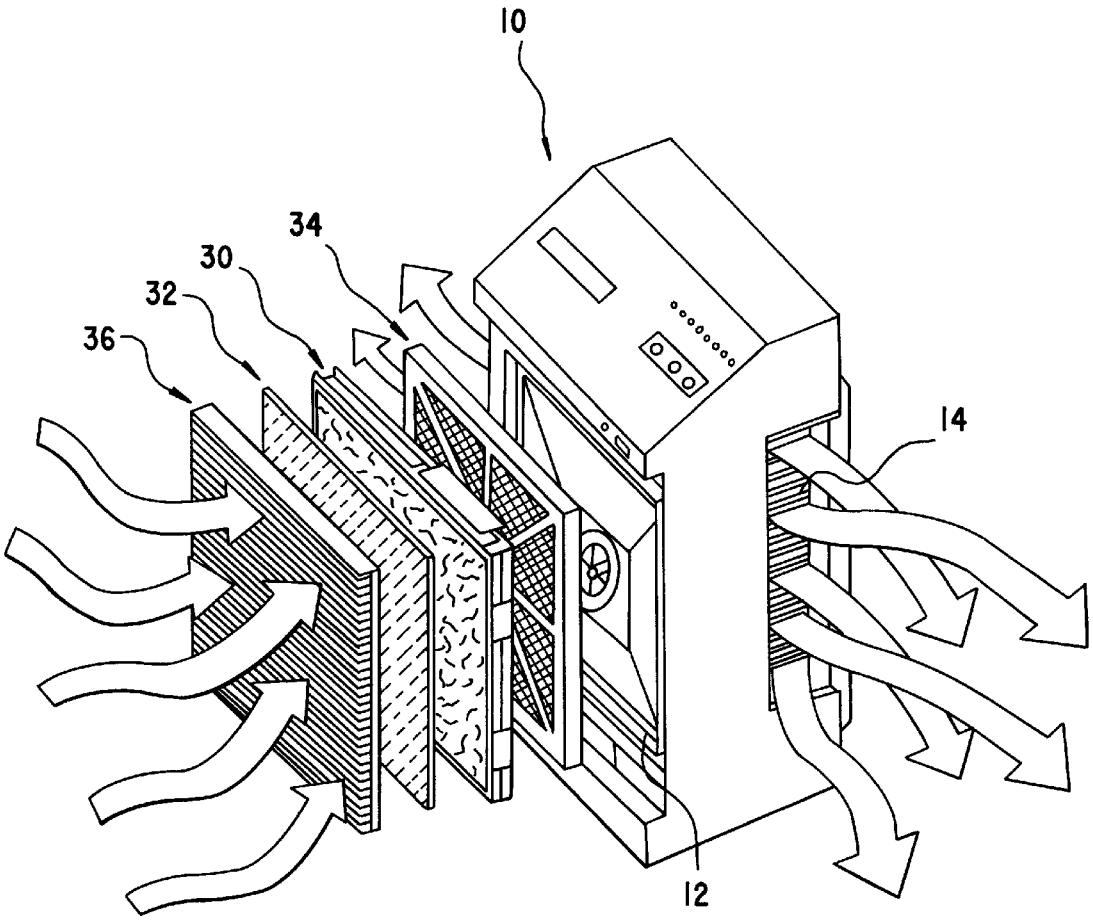
FIG. 4 is a diagram of a free-standing cabinet into which the air filter assembly may be mounted.
Figure 5:
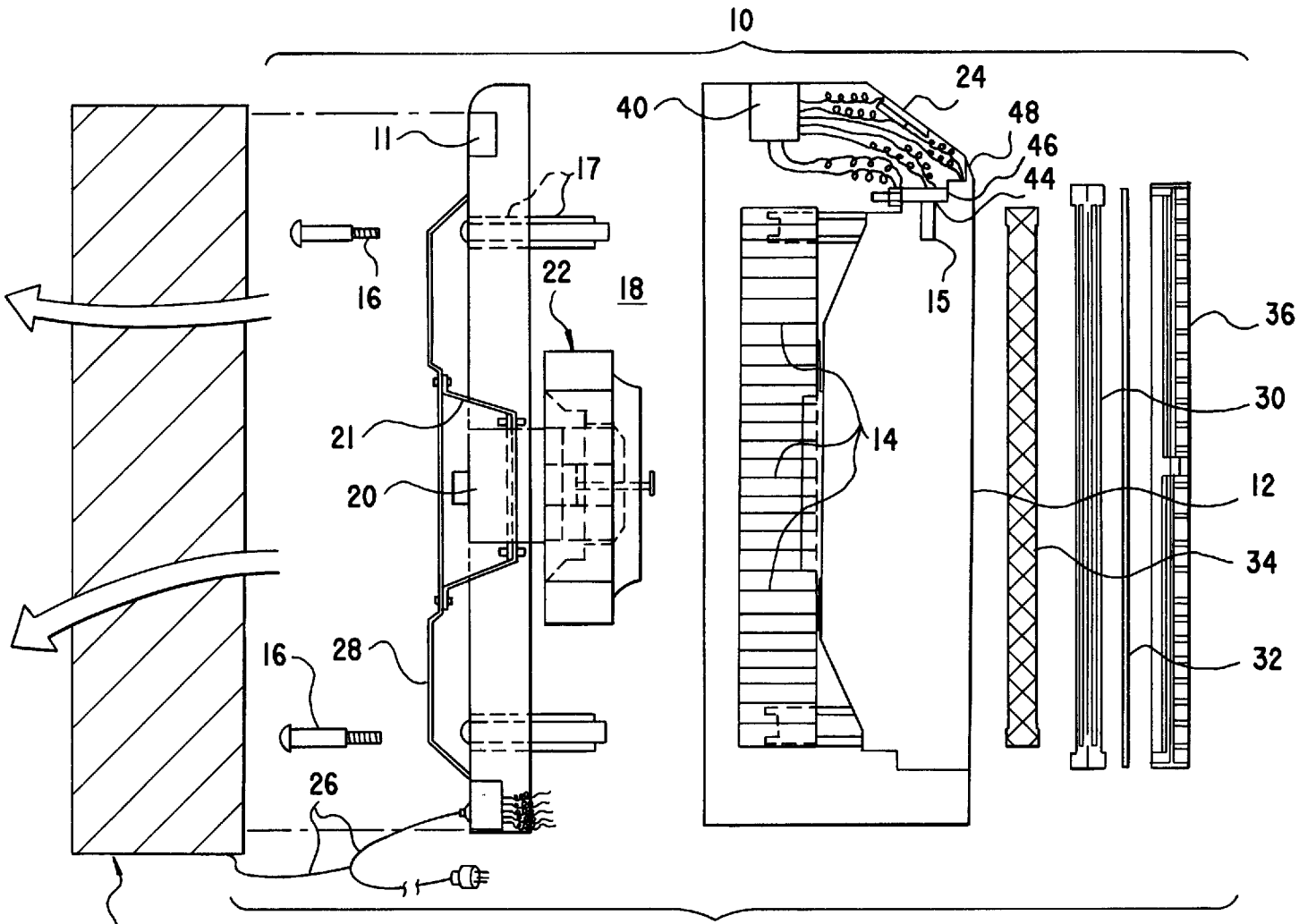
FIG. 5 is a cross sectional view of a free-standing cabinet.

In one embodiment of the invention the air filter assembly 30 is installed in a free-standing cabinet to form a portable console unit primarily for office or residential use, as shown in FIGS. 4 and 5. The cabinet 10 is provided having an inlet 12 on a front side thereof, a pair of outlets 14 on each side thereof, and a back wall 28. A handle indentation 11 is provided on the back wall 28 to enable the console to be hand carried about. The inlet 12 is covered by a filter grille 36, a preliminary mechanical pre-filter 32 of conventional design, the electrostatic air filter assembly and optionally, an activated carbon filter unit 34. An inner plenum chamber 18 is defined to the rear of the filters and forward of the back wall 28. A motor 20 is mounted on a mount 21 on the back wall 28 and carries a fan 22. Conventional electrical controls 24 for the fan motor are provided on an upper surface of the cabinet 10 and a conventional power means 26 is arranged at the rear of the cabinet 10. Nuts 15 and bolts 16 with bolt spacers 17 are provided for holding the assembly together.

In addition, as shown as part 23 of FIG. 5, a low output ionizer arranged to ionize and activate a citrus based solution passed through the ionizer may be incorporated into the console unit with the electrostatic air cleaner to enter the air space and attack odors on proximate surface areas and unpleasant odors in the air mass. The ionizer is electrically powered and, preferably, contains a removable cartridge saturated with a citrus based solution.

Figure 9:
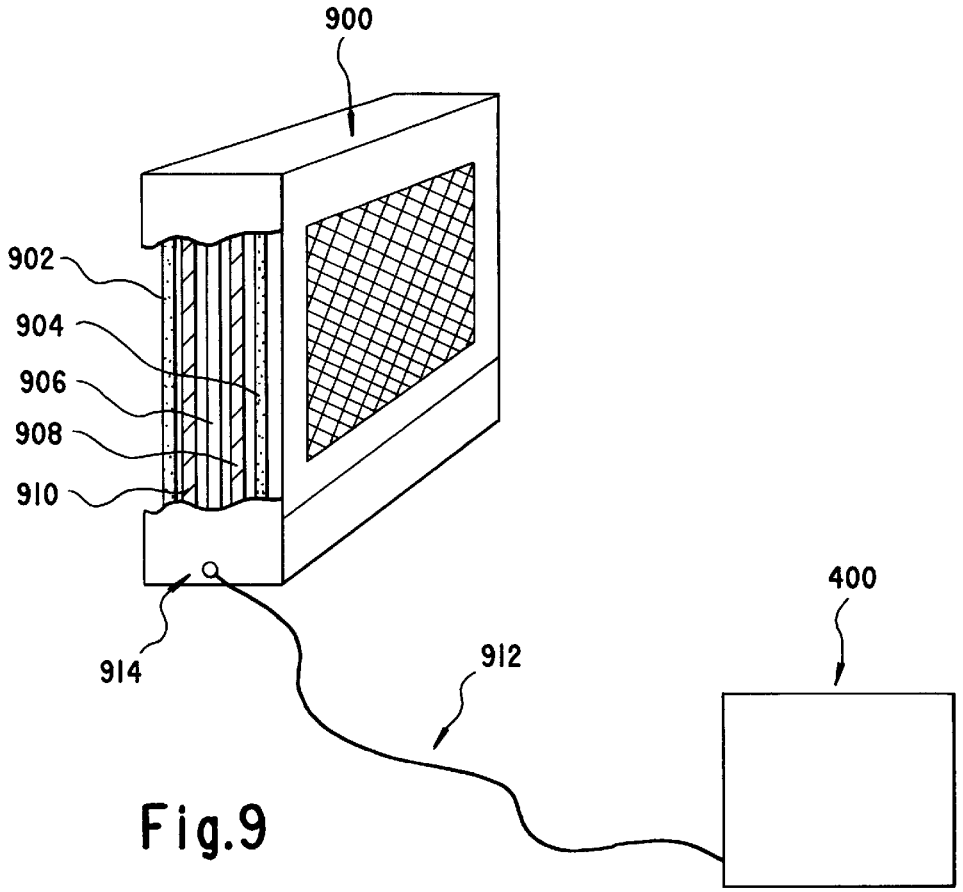
FIG. 9 is a cut away view of an embodiment of the invention in which the filter elements are disposed in a single frame.

In yet another embodiment of the invention shown in FIG. 9, the high voltage power supply 400 may be separate from a single frame 900 containing all of the air filter elements. Preferably the frame 900 is made of a cardboard, plastic or other inexpensive material, and this embodiment would be disposable and sized to fit in standard home or office forced air heating units which accept common fiberglass filters of the type well known to the public. In this embodiment, the single frame contains a charging screen 906 sandwiched between two polyester/wool filter elements 908 and 910, and the filter elements 908, 910 and charging screen 906 are themselves sandwiched between two wire meshes 902 and 904 disposed in the single frame. For this embodiment, the high voltage power supply is not disposed in the frame but, rather, a high voltage wire 912 runs from the remotely positioned high voltage power supply 400 and is electrically connected to the charging screen through a removable connector 914 disposed in the frame 900. The two wire meshes 902 and 904 are connected electrically to ground by virtue of their physical contact with the heating duct into which the frame 900 is installed or by a separate wire not shown.

A comparison of measured performance characteristics of the present invention to characteristics of an air cleaner designed according to the disclosure of U.S. Pat. No. 4,549,887 issued to Joannou (Joannou type device) shows that the present invention performs dramatically better for each of the tested parameters.

One measure of the performance of an air filter is a quantity known as the dust weight arrestance, A, which is defined to be $A=100[1-W_d/W_u]$ (percent) where $W_d$ is the weight of synthetic dust passing through the device and $W_u$ is the weight of dust fed to the device by a specially designed dust feeder. A filter with a high arrestance is, of course, more desirable, because it will remove more dust from the air mass. The measurement of the arrestance of the present invention was performed in accordance with the American Society of Heating, Refrigerating and Air-Conditioning Engineers, Inc. (ASHRAE) standards 52.1-1992, section 11. For this measurement, the air filter assembly is fixed in a test chamber in which small quantities of synthetic dust, in 10 or 15 gram quantities at a time, can be fed through the filter in dust laden air which is forced through the filter at the filter's rated airflow. The nominally rated airflow for the invention is 1200 CFM.

Figure 6:
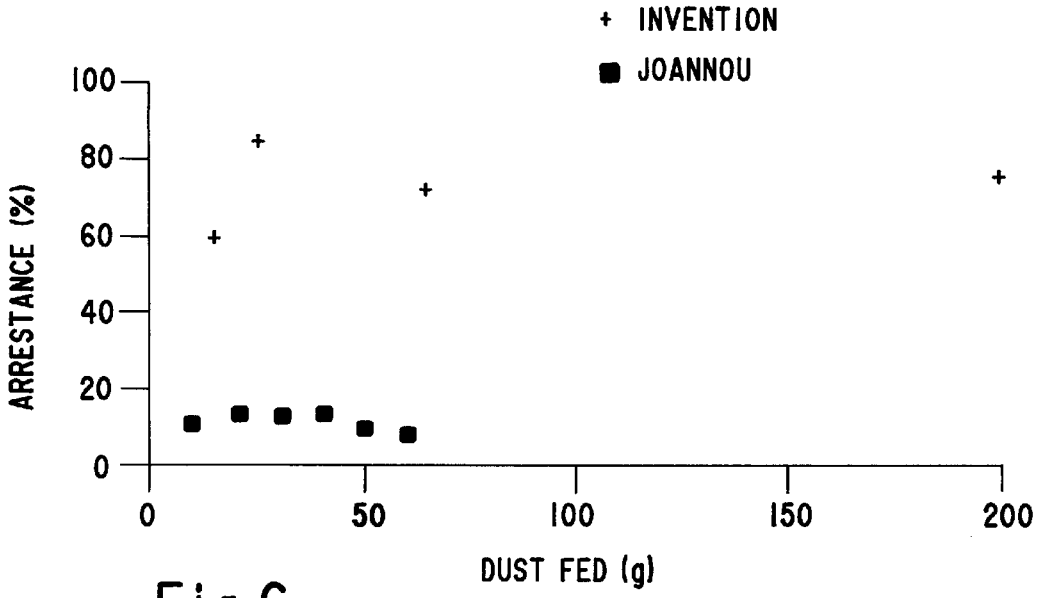
FIG. 6 is a comparison of the Dust Weight Arrestance of the invention to that of a device constructed according to Joannou.

A comparison of the measured arrestance of a Joannou type device to the measured arrestance of the present invention is shown in FIG. 6. Note that the arrestance of the present invention is approximately 6–7 times better than the measured arrestance of the Joannou type design over the weight range of applied dust. In addition, the air filter of the present invention continued to operate even after 200 g of synthetic dust was collected by the filter. In contrast, the Joannou type device failed after only 30 g of synthetic dust had been fed to the filter, and the voltage on the charging screen fell continuously to zero (from a starting value of 5.8 kvolt) as the dust weight approached 30 g. In other words, the Joannou type device filter material, loaded with less than 30 g of dust, began to conduct current as the dust collected and effectively shorted out the high voltage power supply, rendering it useless for gathering further particulates electrostatically.

The filter material used in the Joannou type device was a fiberglass mat which, as indicated by the dust weight arrestance test results, not only has a much smaller total capacity for particulate matter than the new polyester/wool filter material used in the present invention but also "arrests" a much smaller quantity of dust than the new filter at the same rated airflow, even when it's resistance is high enough to sustain a relatively high voltage across the face of the filter.

The new polyester/wool material used in this invention combined with the newly designed, low source resistance high voltage power supply, assures that the air filter assembly captures particulates in the air mass efficiently, without the premature degradation in performance which results when the filter material begins drawing current.

Another measure of the performance of the electrostatic filter is the so called dust-spot efficiency, which compares the optical opacity of two dust samples collected on filter paper in the upstream and downstream sides of the electrostatic filter when the filter is operated at its rated airflow. The measurement of the dust spot efficiency of the present invention was performed in accordance with the American Society of Heating, Refrigerating and Air-Conditioning Engineers, Inc. (ASHRAE) standards 52.1-1992, section 10. The opacity is determined by measuring the light transmission through the sample relative to a transmission standard. The filter paper used to collect the upstream sample is of equal area to the paper used to collect the downstream sample. The dust-spot efficiency is determined by $E=100[1-Z_d/Z_u]$ (percent), where $Z_{u,d}$ are opacity indices of the upstream and downstream samples, respectively, related to the measured opacity, Y, by the relationship $Z=(-73.27)\ln(1-Y/66.07)$. Thus, a filter which removes more particles from the air mass will have a higher dust-spot efficiency.

Figure 7:
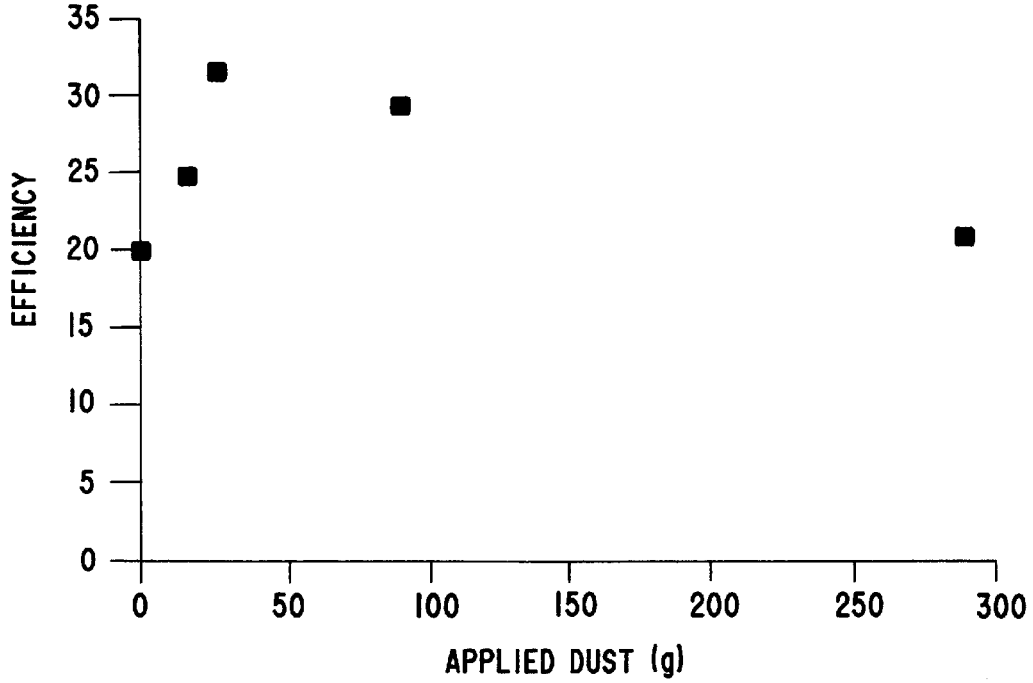
FIG. 7 is a graph of the Dust-Spot Efficiency of the device as a function of the weight of applied dust.

The dust-spot efficiency of the present invention was measured as a function of dust loading up to a total loaded dust weight of 290 g. The results are shown in FIG. 7, where it can be seen that the dust-spot efficiency ranges from a low of 20% to a high of about 32% throughout the weight range of applied dust. In contrast, the dust-spot efficiency of the Joannou type filter was measured to be less than 10% through the limited weight range of applied dust, which terminated at 60 g fiberglass filter became conducting and shorted out the high voltage power supply.

Therefore, the comparative test data show that the new polyester/wool filter material and the low source resistance high voltage power supply of the present invention have resulted in dramatically improved performance and reliability characteristics over previous electrostatic air filter designs.

Further tests of the effectiveness of the present invention were conducted to determine how quickly the filter was able to remove smoke, pollen and dust from the air.

For these tests, the filter was installed in a sealed test room into which a specified quantity of particulate matter could be introduced. The filter assembly was established in a fixture in the test room such that room air could be forced through the filter at the nominal rate of 1200 CFM. The test room was the size of what might be considered an average sized family room, measuring 10.5×12 feet with an 8 foot ceiling. A dust generator, pollen generator and smoke generator were installed in the test chamber, and the concentration of particulates in the air was measured and sized with an aerodynamic particle sizer.

Figure 8:
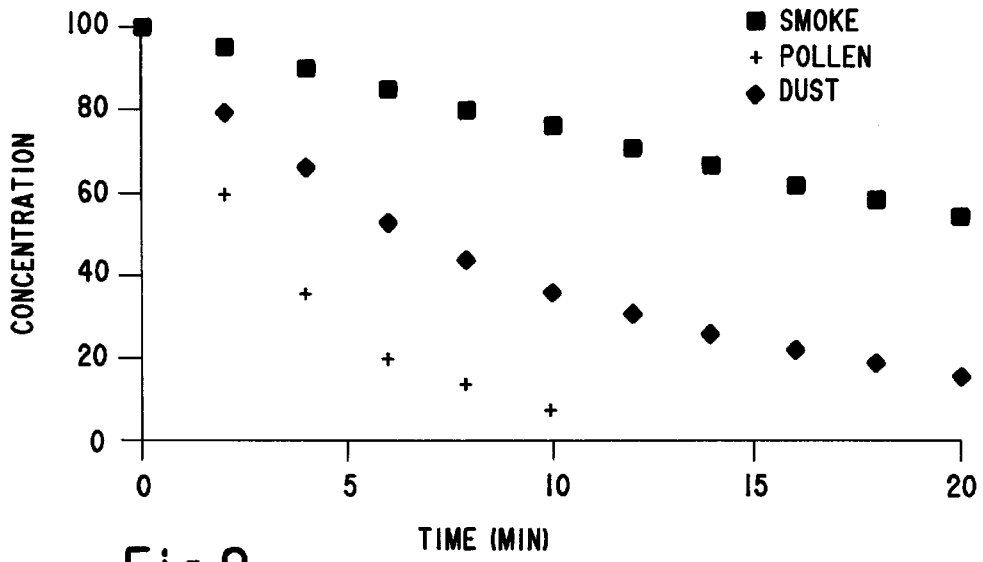
FIG. 8 shows the speed with which the invention can remove smoke, pollen or dust from the air of a closed room as a function of time.

FIG. 8 shows graphically the speed with which smoke, pollen and dust can be removed from room air.

The concentration of smoke in the test room fell to 55% of the starting concentration within 20 minutes, while the concentration of dust fell to 18% in the same time period. Most dramatic were the results for pollen, for which the concentration fell to 8% of the original concentration in a time of only ten minutes.

The electrostatic air cleaner can also be used with an antimicrobial agent, for example, the INTERSEPT® brand of broad spectrum antimicrobial agent (available from Interface Research Corporation of Kennesaw, Ga.), dispersed on the polyester/wool filter material to kill or prevent the growth of bacteria and fungi (including mold and mildew) on the filter material. This will aid in preventing harmful bacteria and other microbes from being introduced into the air by the air cleaner, and should be effective in killing microbes extracted from the air by the filter. The antimicrobial agent will inhibit a wide range of Gram-positive and Gram-negative bacteria including pseudomonas aeruginosa and Staphylococcus aureus.

It is readily apparent that the above-described has the advantage of wide commercial utility. It should be understood that the specific form of the invention hereinabove described is intended to be representative only, as certain modifications within the scope of these teachings will be apparent to those skilled in the art.

What I claim is:

1. An electrostatic air filter assembly comprising:

a first rectangular frame having a top, bottom and two side edges;

a first wire mesh disposed within said first frame;

a second rectangular frame having a top, bottom and two side edges;

a second wire mesh disposed within said second frame, said second frame being joined at one side edge to one side edge of said first frame by a hinge means;

removable first and second rectangular polyester/wool dielectrics disposed between said first and second frames;

a removable rectangular charging screen disposed between said first and second polyester/wool dielectrics for distributing charge to said first and second dielectrics;

a high voltage power supply, having an output terminal and a high voltage wire electrically connected to said output terminal, said power supply being disposed on an edge of said first rectangular frame such that said wire physically and electrically contacts said charging screen when said first and second rectangular frames are closed to form said assembly;

a high resistance low current leakage resistor connected between said output terminal and ground for quickly discharging said charging screen when the high voltage supply is de-energized.

2. An electrostatic air filter assembly as in claim 1, wherein said high voltage power supply comprises:

a direct current power supply stage;

an oscillator stage powered by said direct current power supply;

a step-up transformer having a primary and secondary winding, said primary winding forming an output of said oscillator stage;

a voltage multiplier stage having an input and an output, said input of said multiplier being connected to said secondary winding, wherein said output of said multiplier forms an output of said high voltage power supply.

3. An electrostatic air filter assembly comprising:

a first rectangular frame having a top, bottom and two side edges;

a first wire mesh disposed within said first frame;

a second rectangular frame having a top, bottom and two side edges;

a second wire mesh disposed within said second frame, said second frame being joined at one side edge to one side edge of said first frame by a hinge means;

removable first and second rectangular polyester/wool dielectrics disposed between said first and second frames;

a removable rectangular charging screen disposed between said first and second polyester/wool dielectrics for distributing charge to said first and second dielectrics;

a high voltage power supply, having an input terminal and an output terminal and a high voltage wire electrically connected to said output terminal, said high voltage power supply being disposed on an edge of said first rectangular frame such that said wire physically and electrically contacts said charging screen when said first and second rectangular frames are closed to form said assembly; said high voltage power supply having a direct current power supply stage having an input and an output, wherein said input is connected to an output of an alternating current adapter;

an oscillator stage having an input and an output, said input being connected to said output of said direct current power supply;

a step-up transformer having a primary and a secondary winding, said primary winding forming said output of said oscillator stage;

a voltage multiplier stage having an input and an output, said input of said multiplier being connected to said secondary winding, wherein said output of said multiplier forms an output of said high voltage power supply;

a high resistance, low current leakage resistor connected between said output terminal and ground for quickly discharging said charging screen when the high voltage supply is de-energized.

4. An electrostatic air filter assembly as in claims 1, 3, or 2 wherein the dust weight arrestance of the filter assembly is greater than or equal to 60% for a range of dust loading up to 290 grams at an airflow of 1200 cubic feet per minute.

5. An electrostatic air filter assembly as in claims 1, 3, or 2 wherein the dust spot-efficiency of the filter assembly is greater or equal to 20% for a range of dust loading up to 290 grams at an airflow of 1200 cubic feet per minute.

6. An electrostatic air cleaner console comprising: an air filter assembly having a first rectangular frame having a top, bottom and two side edges;

a first wire mesh disposed within said first frame;

a second rectangular frame having a top, bottom and two side edges;

a second wire mesh disposed within said second frame, said second frame being joined at one side edge to one side edge of said first frame by a hinge means;

first and second rectangular polyester/wool dielectrics disposed between said first and second frames;

a removable rectangular charging screen disposed between said first and second polyester/wool dielectrics for distributing charge to said first and second dielectrics;

a high voltage power supply, having an output terminal and a high voltage wire electrically connected to said output terminal, said power supply being disposed on an edge of said first rectangular frame such that said wire physically and electrically contacts said charging screen when said first and second rectangular frames are closed to form said assembly;

a high resistance low current leakage resistor connected between said output terminal and ground for quickly discharging said charging screen when the high voltage supply is deengergized;

wherein said air filter assembly is disposed in a cabinet having a means for supplying electrical power to said air filter assembly;

said cabinet housing a means for forcing room air through said air filter assembly and exhausting said air from said cabinet.

7. An electrostatic air cleaner console as in claim 6 further comprising a low output ionizer for activating a citrus based solution wherein said ionizer is placed into said cabinet such that an activated portion of said solution is introduced into an air mass flowing through said cabinet.

8. An electrostatic air filter assembly comprising:

a rectangular frame having a top, bottom and two side edges;

first and second wire meshes disposed within said frame;

first and second rectangular polyester/wool dielectrics disposed between said first and second wire meshes;

a rectangular charging screen disposed between said first and second polyester/wool dielectrics for distributing charge to said first and second dielectrics;

a high voltage power supply, having an output terminal and a high voltage wire electrically connected to said output terminal, such that said wire is electrically connected to said charging screen;

a high resistance low current leakage resistor connected between said output terminal and ground for quickly discharging said charging screen when the high voltage supply is de-energized.

9. An electrostatic air filter assembly as in claim 8, wherein said high voltage power supply comprises:

a direct current power supply stage;

an oscillator stage powered by said direct current power supply;

a step-up transformer having a primary and secondary winding, said primary winding forming an output of said oscillator stage;

a voltage multiplier stage having an input and an output, said input of said multiplier being connected to said secondary winding, wherein said output of said multiplier forms an output of said high voltage power supply.

* * * * *